United States Patent [19]

August

[11] Patent Number: 4,809,929

[45] Date of Patent: Mar. 7, 1989

[54] SPLITTER PLATES FOR ALLEVIATION OF MISSILE HOOK DRAG

[75] Inventor: Henry August, Chatsworth, Calif.

[73] Assignee: Hughes Aircraft Company, Los Angeles, Calif.

[21] Appl. No.: 66,449

[22] Filed: Jun. 26, 1987

[51] Int. Cl.[4] ..... F42B 15/053

[52] U.S. Cl. ..... 244/3.28; 244/3.27

[58] Field of Search ..... 244/3.1, 3.24, 3.27, 244/3.28

[56] References Cited

U.S. PATENT DOCUMENTS

| | | | |
|---|---|---|---|
| 3,695,556 | 10/1972 | Gauzza et al. | 244/3.28 |
| 4,411,398 | 10/1983 | Wedertz et al. | 244/3.28 |
| 4,709,878 | 12/1987 | Titley | 244/3.28 |

*Primary Examiner*—Stephen C. Bentley
*Assistant Examiner*—R. L. Klein
*Attorney, Agent, or Firm*—Michael W. Sales; A. W. Karambelas

[57] ABSTRACT

The overall drag upon a missile body after launch can be reduced and hence the range and average speed of the missile increased by reducing the aerodynamic drag at supersonic velocities attributable to missile hooks which are normally used to attach and launch the missile body from a launcher assembly. After launch a pair of splitter plates are popped up into position next to each missile hook. One splitter plate is positioned in front of the missile hook and a second splitter plate positioned behind the missile hook. The splitter plates are generally planar and arranged so that their planar surfaces are approximately parallel to the fore and aft direction of the missile body. In the illustrated embodiment, the splitter plates are erected into an operative configuration with respect to their missile hooks by rotating each splitter plate about a hinge line. The splitter plate is biased to assume the erect configuration by means of a torsion spring. An electromechanical latch maintains the splitter plates in a folded configuration against the missile body until the missile body has cleared the launch assembly. Thereafter the latch releases the splitter plates allowing the torsional spring to rotate each splitter plate into an operative configuration. Upon full erection of each splitter plate, each splitter plate is mechanically locked into the erect configuration. In one embodiment a fifty percent reduction in the drag coefficient is realized at supersonic velocities as a result of the splitter plates.

16 Claims, 4 Drawing Sheets

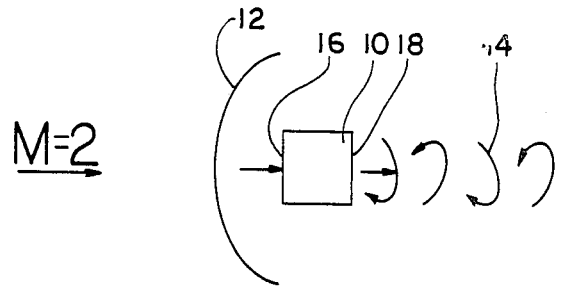
FIG. 1a
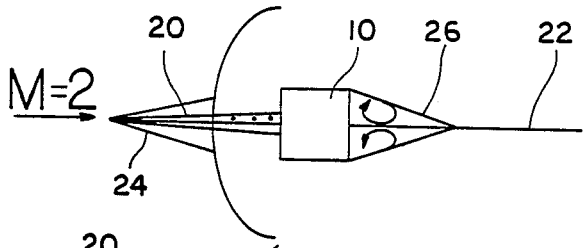
FIG. 1b
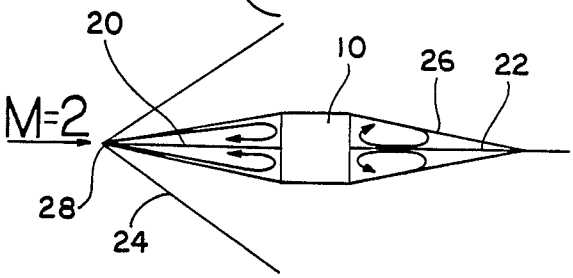
FIG. 1c
FIG. 8
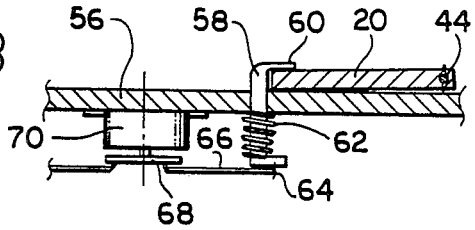
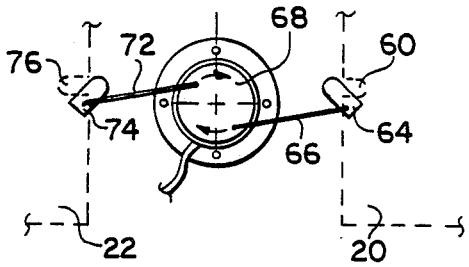
FIG. 9

SPLITTER PLATES FOR ALLEVIATION OF MISSILE HOOK DRAG

BACKGROUND OF THE INVENTION

1. Field of the Invention

The invention relates to the field of air launched missiles and in particular to the aerodynamics of fittings or fixtures attached to such air launched missiles.

2. Description of the Prior Art

The range and speed of a missile is directly dependent upon the aerodynamic drag of the missile. Thus it has been a long felt need to reduce any contribution to drag. However, a number of fixtures must be attached to the missile body for the purposes of carriage and launch, all of which fixtures contribute to drag and measurably reduce the range and speed of the missile. Typically, the drag caused by such fixtures or other projections from an aircraft body or missile is minimized by providing fore and aft aerodynamic fairings adjacent to the fixture. However, the long fore and aft streamlined shape of the aerodynamic fairings are incompatible with the requirements placed upon fixtures which are connected with air launched missiles, typically missile hooks. The launcher and ejector geometry generally comprise constraints upon attachment clearances which prevent the effective use of conventional aerodynamic fairings.

Previous efforts undertaken by this inventer to provide for mechanical pop-up aerodynamic fairings have resulted in fairings which are complex, are characterized by accentuated fore and aft lengths, and which generally add a considerable amount of weight to the missile body. Conventional pop-up aerodynamic fairings have almost universally been impractical or unfeasible for missile hook applications.

Therefore, what is needed is some type of device which may be used in a missile hook application to minimize the drag on air launched missiles which is not subject to each of the defects of the prior art discussed above.

BRIEF SUMMARY OF THE INVENTION

The invention is an improvement in an apparatus for attaching a missile to a launching assembly. The launching assembly includes at least one missile hook attached to the missile. The improvement comprises a splitter plate rotatably attached to the missile. The splitter plate is disposed adjacent to the missile hook.

A first mechanism is provided for retaining the splitter plate in a folded configuration against the missile to maintain the splitter plate in a noninterfering installed configuration with respect to the missile hook launcher assembly.

A second mechanism, actuated just after missile launch, is provided for erecting the splitter plate into a predetermined configuration with respect to the adjacent missile hook to reduce aerodynamic drag on the missile hook during missile flight. As a result the drag of the missile is reduced and range and average speed of the missile is increased.

The improvement further comprises a third mechanism for locking the splitter plate into the erected configuration.

In particular one embodiment of the improvement comprises a pair of dual splitter plates is provided for the missile hook. A first one of the pair of dual splitter plates is erected forward of the missile hook, and a second one of the pair of dual splitter plates is erected aft of the missile hook.

In the case where the missile includes a plurality of the missile hooks, each missile hook is provided with at least one splitter plate.

In the illustrated embodiment the splitter plate is generally rectangular. The splitter plate has a height approximately equal to the height of the corresponding missile hook and a length approximately equal to twice the width of the missile hook.

In one embodiment the second mechanism is a torsion spring having one end bearing against the splitter plate. The splitter plate is rotatably coupled to the missile about a hinge pin. The torsion spring is disposed about the hinge pin.

In one embodiment the third mechanism comprises a flat spring coupled to the missile and a notched portion in the splitter plate. The splitter plate is rotated until the flat spring engages the notched portion. Rotation of the splitter plate at least in one direction thereafter is prohibited by engagement of the flat spring in the notched portion of the splitter plate.

The invention is also characterized as a method for reduction of aerodynamic drag on a missile hook attached to a missile body. The missile hook is provided for attaching the missile body to a missile hook assembly. The method comprises the steps of launching the missile body from the hook assembly and erecting a splitter plate fore and aft of the missile hook after launch. The splitter plate is generally planar and has a surface oriented fore and aft on the missile body. The splitter plate is erected immediately forward of and aft of the missile hook. As a result aerodynamic drag of the missile hook is significantly decreased and the range and speed of the missile body is substantially increased.

The method further comprises the step of locking the splitter plates into the erect configuration just after the missile is launched from an aircraft.

The method still further comprises the step of maintaining the splitter plates in a folded configuration against the missile body during the step of launching.

The invention is also defined as an apparatus for extending the range and maintaining higher speed of a missile. The missile is attached to a launcher assembly by a plurality of missile hooks. The apparatus comprises a mechanism for reducing drag of each missile hook, a mechanism for maintaining the first mechanism in a noninterfering configuration with the launcher assembly, and a mechanism for selectively configuring the mechanism for reducing drag into an operative relationship with each of the missile hooks after launch of the missile body from the launcher assembly. As a result the missile's range and average speed are substantially increased by reduction of drag contributed by the missile hooks. The improvement can be retrofitted into existing missile designs without requiring extensive redesign.

The invention and its various embodiments may be better understood by turning to the following figures wherein like elements are referenced by like numerals.

BRIEF DESCRIPTION OF THE DRAWINGS

FIG. 1*a* is a top diagrammatic view of the shock wave and turbulent wake flow established in the vicinity of a block, which simulates a missile hook in a supersonic air flow.

FIG. 1*b* is a diagrammatic top plan view of the block of FIG. 1*a* shortly after splitter plates have been erected fore and aft of the block.

FIG. 1*c* is a top diagrammatic plan view of the block of FIG. 1*b* showing the shock wave and turbulent wake flow about the block at equilibrium after the splitter plates are erected.

FIG. 8 is a fragmentary view of one of the splitter plates showing the mechanism for latching the splitter plate in a folded configuration.

FIG. 9 is a plan view of the latching mechanism of FIG. 8.

Figure 4:
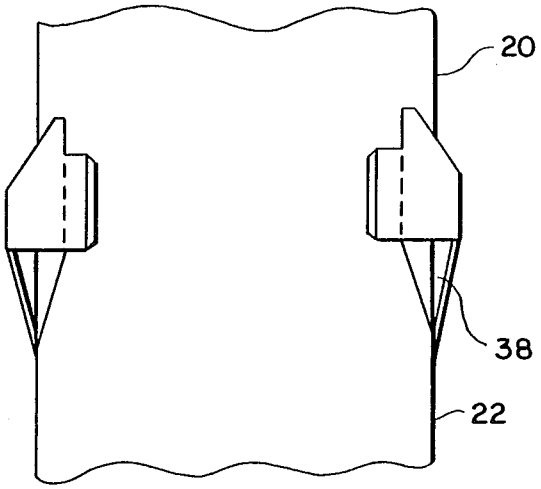
FIG. 4 is a top plan view of the missile hook of FIGS. 2 and 3.

The invention and its various embodiments may now be better understood by turning to the following detailed description.

DETAILED DESCRIPTION OF THE PREFERRED EMBODIMENTS

What is proposed is the disposition of a flat plate fore and aft of a blunt missile hook which is subjected to supersonic flow. The flat plates will normally be folded downwardly against the body of the missile so that the plates will not interfere with any fixtures or elements of the missile carriage or launching assemblies. After launch, the flat plates will be erected in the manner described below to reduce the coefficient of drag of the blunt missile hook. The forward or leading flat plate, having its plane in a fore and aft direction generally parallel to the forward flight of the missile, separates the high drag bow shock of the blunt missile hook along the surface of the plates. As a result, the bow shock changes to a weaker, oblique shape. This weaker shock will reduce the pressure acting on the missile hook and therefore reduce its drag. The splitter plate placed aft of the missile hook serves to stabilize the vortex shedding and provides a physical boundary for the attachment of a separated base flow. The aft splitter plate increases the base pressure and thereby assists to reduce drag.

The total drag acting upon a missile body after the time of launch can be reduced (hence the range and average speed of the missile increased) by reducing the aerodynamic drag at supersonic velocities. A significant portion of the drag at supersonic velocities is attributable to missile hooks which are normally used to attach and launch the missile body from a launcher assembly. After launch a pair of splitter plates are popped up into position next to each missile hook. One splitter plate is positioned in front of the missile hook and a second splitter plate positioned behind the missile hook. The splitter plates are generally planar and arranged so that their planar surfaces are approximately parallel to the fore and aft direction of the missile body. In the illustrated embodiment, the splitter plates are erected into an operative configuration with respect to their missile hooks by rotating each splitter plate about a hinge line. Tee splitter plate is biased to assume the erect configuration by means of a torsion spring. An electromechanical latch maintains the splitter plates in a folded configuration against the missile body until the missile body has cleared the launch assembly. Thereafter the latch releases the splitter plates allowing the torsional spring to rotate each splitter plate into an operative configuration. Upon full erection of each splitter plate, each splitter plate is mechanically locked into the erect configuration. In one embodiment a fifty percent reduction in the drag coefficient is realized at supersonic velocities as a result of the splitter plates.

The operation of the splitter plates can be diagrammatically understood by first turning to the depictions of FIGS. 1*a*–1*c*. FIG. 1*a* shows a diagrammatic top plan view of a blunt missile hook, generally denoted by reference numeral 10. In the depiction of FIGS. 1*a*14 1*c* missile hook 10 is represented simply as a square. At supersonic flows, for example at approximately Mach 2, a bow shock wave 12 is established in front of hook 10. Behind hook 10 is a series of vortices 14. Stagnation pressure thus builds up on forward face 16 of hook 10 and a weak base pressure similarly develops at the rear surface 18 of hook 10. Both the stagnation and weak base pressures serve to create a drag on hook 10.

FIG. 1*b* illustrates the aerodynamic flow just after erection of the forward splitter plate 20 and aft splitter plate 22 next to hook 10. Equilibrium has not yet been achieved in the plan diagrammatic view of FIG. 1*b*. However, forward splitter plate 20 can be seen as beginning to establish a weaker oblique shock wave 24 and aft plate 22 beginning to stabilize vortex shedding and provide a physical boundary for separated base flow 26.

FIG. 1*c* diagrammatically depicts blunt missile hook 10 after the establishment of equilibrium. Shock wave 12 in FIG. 1*a* has now been transformed into a more oblique shock wave 24 originating from the leading edge 28 of forward splitter plate 20. Similarly, separated base flow 26 has lengthened as compared to the condition depicted in FIG. 1*b*. The shock boundary layer interaction forward of the high drag blunt missile hook 10 created by forward splitter plate 20 separates the boundary layer. Pressure acting on the upstream face 16 of hook 10 is thereby reduced compared to the bow shock of FIG. 1*a*. Aft splitter plate 22 similarly increases the base pressure acting on hook 10 and hence reduces the effective drag.

Figure 5:
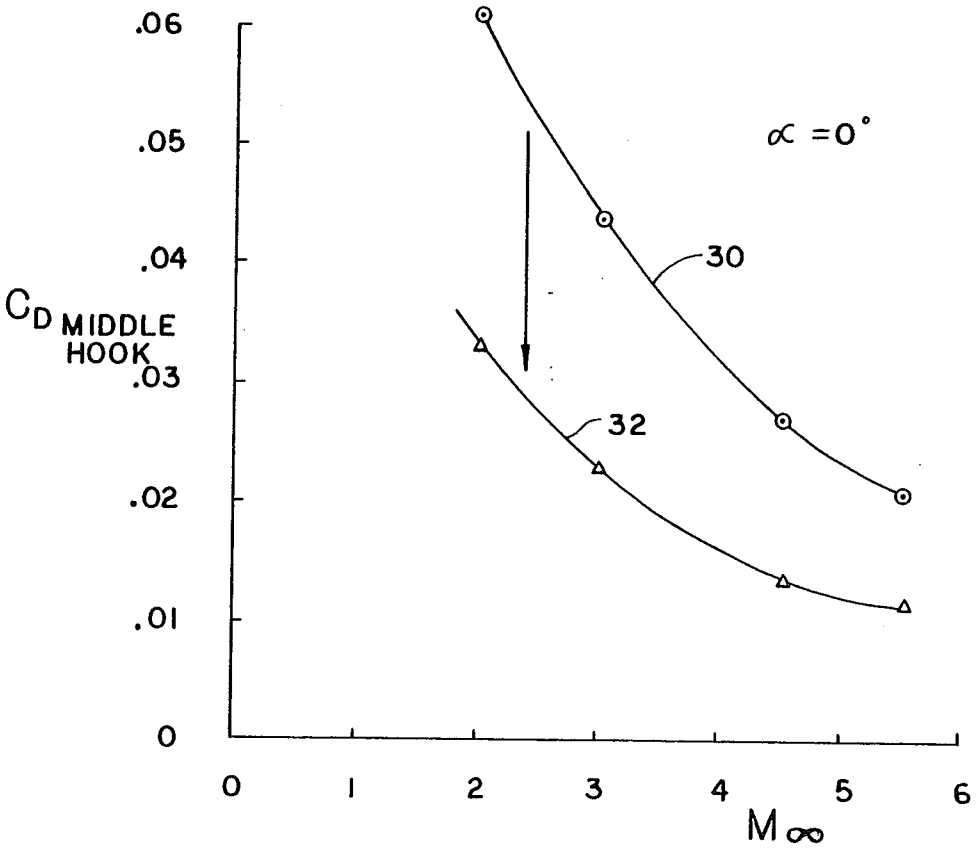
FIG. 5 is a graphic depiction of the drag coefficient, Cd, of the missile hook of FIGS. 2–4 shown with and without the splitter plate in place.

Before considering how splitter plates 20 and 22 are erected or pop up into place after launch, first further consider their aerodynamic effect on a missile hook as graphically depicted in FIG. 5. FIG. 5 is a graphic depiction of the drag coefficient of the middle hook of a missile of the design shown in FIGS. 2–4. There is no standard or universally used missile hook configuration. In the illustrated embodiment the missile is provided with three pairs of hooks. A first pair provides a leading means of attachment and is followed by a middle and trailing pair of hooks. The shape of the hooks among the pairs varies. The middle pair of the hooks has been chosen arbitrarily for illustration, thus the drawings should not be read as limiting the invention in any way.

The vertical axis represent the drag coefficient while the Mach number is represented by the horizontal axis. A noninclined or zero degree angle of attack is assumed. Line 30 represents the actually measured drag coefficient of the hook of FIGS. 2–4 at various Mach speeds. The drag coefficient thus decreases from approximately 0.06 at Mach 2 to approximately 0.02 at Mach 5.5. With the fore and aft splitter plates in place, as diagrammatically depicted in FIGS. 1*a*–1*b*, and as more particularly shown and described below in connection with FIGS. 2–4, the drag coefficient of hook 10 decreases from that depicted by line 30 to that depicted by line 32 in FIG. 5. The drag coefficient is approximately 0.35 at Mach 2 and decreases to slightly in excess of 0.01 at Mach 5.5. A reduction of approximately 50% in the middle hook drag is achieved at these supersonic Mach numbers when splitter plates according to the invention are employed.

Figure 3:
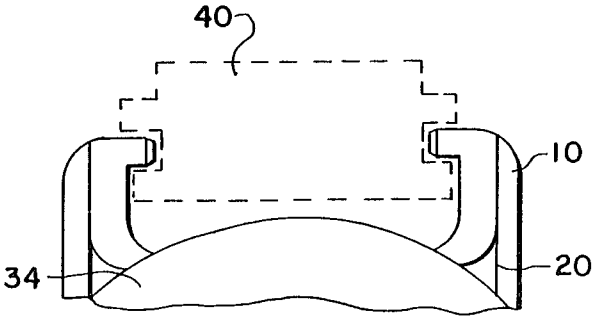
FIG. 3 is a front view of the missile hook of FIG. 2.
Figure 2:
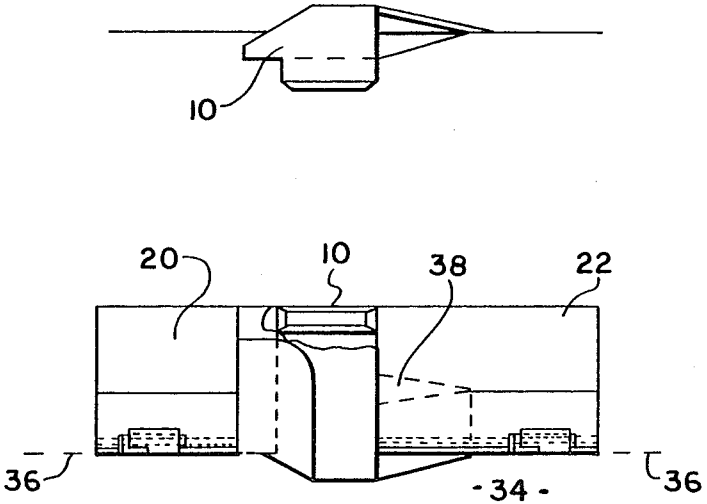
FIG. 2 is an inside side view of a missile hook with splitter plates shown erected.

Turn now to the more detailed depiction of FIGS. 2–4 wherein one embodiment of the invention is specifically illustrated. FIG. 2 is an inside side view of a middle missile hook 10 showing splitter plates 20 and 22 in the erected configuration. Plates 20, 22 are hinged to body 34 of the missile along a hinge line 36. As depicted in the top plan view of FIG. 4, forward plate 20 rotates in a clockwise sense from a folded configuration (not shown) against the missile body to the erected configuration of FIGS. 3 and 4 when viewed from the forward to aft direction depicted in FIG. 3. On the other hand, aft splitter plate 22 rotates in the opposite direction, namely in a counterclockwise sense from a folded configuration (not shown) to the erected configuration of FIGS. 3 and 4. The sense of rotation is largely determined by the geometry of the missile hook 10 which includes a trailing strut portion 38 best depicted in FIGS. 2 and 4. It may readily be appreciated by viewing FIG. 3 that portions or fixtures of the missile hook or launching assembly 40, depicted in dotted outline in FIG. 3, would otherwise prohibit the permanent placement of splitter plates 20, 22.

It should be borne in mind that assembly 40 must provide a secure and reliable means of missile attachment and launch under extreme conditions of load, drag and orientation. This necessarily includes some type of fore and aft affixation of the missile through missile hook 10 to assembly 40. This affixation interferes with and prohibits the permanent disposition of aerodynamic elements, such as splitter plates 20 and 22 in connection with missile hook 10.

Figure 6A:
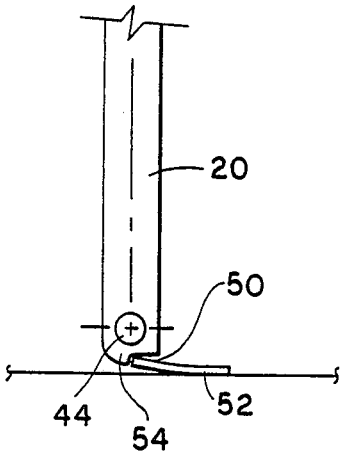
FIGS. 6*a* and 6*b* are fragmented views in enlarged scale of the splitter plate shown in erected and folded configuration respectively as seen through line 6—6 of FIG. 2.
Figure 6B:
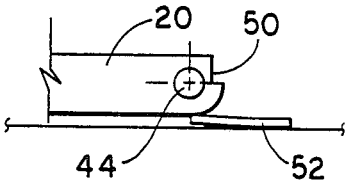
Figure 7A:
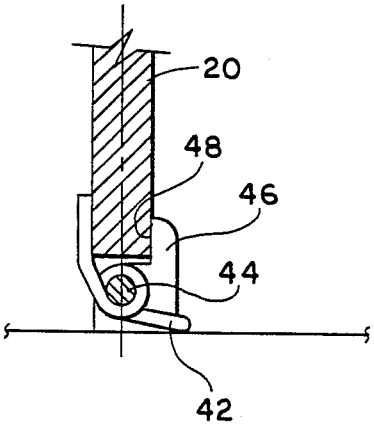
FIGS. 7*a* and 7*b* are fragmentary views of the splitter plate of FIG. 2 shown in enlarged scale as seen through line 7—7 of FIG. 2.
Figure 7B:
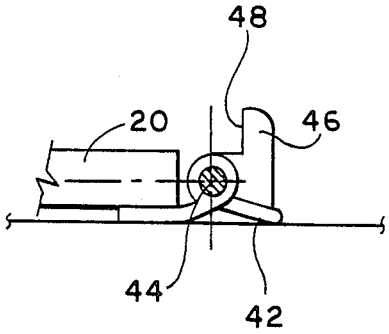

Consider now the attachment of splitter plates 20 and 22 to the missile body as depicted in detail in FIG. 2 and specifically in connection with FIGS. 6*a*–6*b* and 7*a*–7*b*. Splitter plate 20 is erected into place by a coil spring 42 as best depicted in FIGS. 7*a* and 7*b*. FIGS. 7*a* and 7*b* are fragmentary depictions of splitter plates, taken in this example as the forward splitter plate 20 and shown in enlarged scale as seen through line 7—7 of FIG. 2. A similar depiction would exist in the case of aft splitter plate 22. Coil spring 42 is disposed about a hinge rod 44. Hinge rod 44 in turn is disposed through a hinge block 46. Hinge block 46 has a shoulder 48 opposing splitter plate 20. FIG. 7*a* depicts splitter plate 20 in the folded configuration. After splitter plate 20 is released, spring 42 urges splitter plate 20 upwardly and into the erect configuration shown in FIG. 7*a*. Plate 20 is urged against shoulder 48 of block 46 which then defines its erect orientation.

Once splitter plates 20 and 22 are erected by the mechanism such as shown in FIGS. 7*a* and 7*b*, it is locked into the erect configuration by a spring locking mechanism best depicted in FIGS. 6*a* and 6*b* as seen in fragmentary enlarged scale through lines 6—6 of FIG. 2. Turning specifically to FIGS. 6*a*–6*b*, it can be seen that plate 20, as it rotates from the folded configuration of FIG. 6*b*, presents a notched basal portion 50 to a curved flat spring 52. When erected as shown in FIG. 6*a*, notched portion 50 snaps over spring 52 thereby allowing the opposing end 54 of spring 52 to abut notched portion 50. In this manner, the counterclockwise rotation of plate 20 or its rotation back to the folded configuration of FIG. 6*b* is prevented.

Now consider the means whereby splitter plates 20 and 22 are retained and then released from the folded configuration after launch. Turning specifically to FIG. 8, a cross-sectional fragmentary portion of the missile skin 56 is illustrated with plate 20 folded against it. The diagrammatic depiction of FIG. 8 shows missile skin 56 as a straight segment. However, it is to be expressly understood that the missile skin is curved and generally cylindrical. Thus, plate 20, which may be resilient, can be folded to temporarily assume the curved body shape of skin 56. It is also within the scope of the invention that splitter plates 20 and 22 may be rigid. In any case, plate 20 is folded downwardly against skin 56 and retained there by rotatable latch 58. Latch 58 includes a finger portion 60 which extends over the end of plate 20. Latch 58 is pulled downwardly into the missile body means of a compression traction spring 62 which is disposed within the missile body and has one end bearing against the underside of missile skin 56 and the opposing end bearing against a lever arm 64 which is attached to the inner end of latch 58. Lever arm 64 is coupled by means of a rod or cable 66 to a rotating plate 68. Rotating plate 68 in turn is rotated by an electrical motor 70 attached to the underside of skin 56 within the missile body.

As best seen in the diagrammatic plan view of FIG. 9, rotating plate 68 is also similarly attached by means of a rod or cable 72 to a corresponding arm 74 attached to the bottom of an aft latch similar to forward latch 58. In the same manner as with forward splitter plate 20, aft splitter plate 22, shown in dotted outline in FIG. 9, is selectively locked into the forward configuration.

Upon missile launch, a sequence of events is then electronically activated in the missile according to conventional design. Included among these activation or arming signals is the activation of electric motor 70 to rotate through a predetermined angular segment thereby releasing latches 58. Splitter plates 20 and 22 are then quickly erected under the urging of coil springs 42 and locked into place by means of coaction of notch 50 and flat spring 52. The erected configuration of splitter plates 20 and 22 as depicted in FIGS. 2–4 is then assured with the resulting aerodynamic effects as diagrammatically depicted in FIGS. 1*a*–1*c* and the graph of FIG. 5.

It must be understood that many modifications and alterations may be made by those having ordinary skill in the art without departing from the spirit and scope of the invention. For example, in the illustrated embodiment a single set of missile hooks was depicted. Normally, a plurality of such missile hook pairs are included on any missile and fore and aft splitter plates may then be provided for each hook on the missile. On the particular missile of which the hook of FIGS. 2–4 is employed, there are three pairs of similar hooks. Thus, each hook would be provided with a fore and aft splitter plate, or twelve splitter plates are provided altogether for the entire missile hook assembly. Furthermore, the configuration of the missile hooks varies dramatically with the design and mission of each missile and its intended adaptability to many launchers. Therefore, the design of the splitter plates will differ for each missile application depending on the details of the missile hook and launch assembly. Therefore, it must be understood that the illustrated embodiment has been set forth only by way of example and not as limiting the invention, which is defined in the following claims.

What is claimed is:

1. An improvement in an apparatus for attaching a missile to a launching assembly, said launching assembly including at least one missile hook attached to said missile, said improvement comprising:

a splitter plate rotatably attached to said missile, said splitter plate disposed adjacent to said missile hook;

first means for retaining said splitter plate in a folded configuration against said missile to maintain said splitter plate in a noninterfering configuration with respect to said missile hook assembly; and second means for erecting said splitter plate into a predetermined configuration with respect to said adjacent missile hook to reduce aerodynamic drag on said missile hook, whereby drag of said missile is reduced and range and average speed of said missile is increased.

2. The improvement of claim 1 further comprising a third means for locking said splitter plate into said erected configuration.

3. The improvement of claim 1 wherein a pair of said splitter plates is provided for said missile hook, a first one of said pair of said splitter plates is erected forward of said missile hook and a second one of said pair of splitter plates is erected aft of said missile hook.

4. The improvement of claim 1 wherein said missile includes a plurality of said missile hooks and wherein each missile hook is provided with at least one splitter plate.

5. The improvement of claim 4 wherein a pair of said splitter plates is provided for each said missile hook, a first one of said pair of said splitter plates erected forward of said missile hook and a second one of said pair of splitter plates is erected aft of said missile hook.

6. The improvement of claim 5 further comprising a third means for locking said splitter plate into said erected configuration.

7. The improvement of claim 1 wherein said splitter plate is generally rectangular, said splitter plate having a height approximately equal to the height of said corresponding missile hook and said splitter plate having a length approximately equal to twice the width of said missile hook.

8. The improvement of claim 6 wherein said splitter plate is generally rectangular, said splitter plate having a height approximately equal to the height of said corresponding missile hook and said splitter plate having a length approximately equal to twice the width of said missile hook.

9. A method for reduction of aerodynamic drag on a missile hook attached to a missile body, said missile hook for attaching said missile body to a missile hook assembly, said method comprising the steps of:

launching said missile body from said hook assembly; and erecting a splitter plate fore and aft of said missile hook after launch, said splitter plate being generally planar and having a surface oriented fore and aft on said missile body, said splitter plate being erected immediately forward of and aft of said missile hook, whereby aerodynamic drag of said missile hook is substantially reduced and range and average speed of said missile body is substantially increased.

10. The method of claim 9 further comprising the step of locking said missile plates into said erect configuration.

11. The method of claim 9 further comprising the step of maintaining said splitter plates in a folded configuration against said missile body prior to said step of launching.

12. The method of claim 11 further comprising the step of locking said missile plates into said erect configuration.

13. An apparatus for extending the range and speed of a missile, said missile attached to a launcher assembly by a plurality of missile hooks, said apparatus comprising:

first means for reducing drag of each missile hook;

second means for maintaining said first means in a noninterfering configuration with said launcher assembly; and third means for selectively configuring said first means into an operative relationship with each of said missile hooks after launch of said missile body from said launcher assembly, whereby said missile's range and average speed are increased by reduction of drag contributed by said missile hooks and without requiring redesign or incurring interference with said launcher assembly.

14. The apparatus of claim 13 wherein said first means is a pair of splitter plates corresponding to each missile hook, one of said pair of splitter plates being disposed forward of said missile hook and the other one of said pair of splitter plates being disposed aft of said missile hook, said splitter plates being generally planar and having the plane of each splitter plate aligned fore and aft with respect to said missile body.

15. The apparatus of claim 13 wherein said second means is an electromechanically actuated latch coupled to said first means for selectively maintaining said first means in an inoperative noninterfering configuration.

16. The apparatus of claim 13 wherein said third means releases said first means from said noninterfering configuration and wherein said third means rotates said first means into said operative configuration after launch of said missile body from said launcher assembly.

* * * * *